US005842778A

United States Patent [19]

Maring

[11] Patent Number: 5,842,778

[45] Date of Patent: Dec. 1, 1998

[54] BELL-SHAPED CHRISTMAS TREE LIGHT COVER

[76] Inventor: Joan Maring, 165 Washburn Ave., San Jacinto, Calif. 92583

[21] Appl. No.: 916,508

[22] Filed: Aug. 22, 1997

[51] Int. Cl.[6] ..... F21V 17/04

[52] U.S. Cl. ..... 362/237; 362/391; 362/407; 362/408; 362/438; 362/454; 362/806

[58] Field of Search ..... 362/249, 251, 362/252, 363, 391, 396, 806, 808, 237, 407, 408, 437, 438, 439, 443, 448, 453, 454

[56] References Cited

U.S. PATENT DOCUMENTS

| | | | |
|---|---|---|---|
| D. 272,523 | 2/1984 | P'eng | D10/116 |
| 2,664,497 | 12/1953 | Reynolds | 362/808 |
| 3,011,049 | 11/1961 | Kinghorn | 362/396 |
| 3,253,137 | 5/1966 | Richter, III | 362/249 |
| 3,505,709 | 4/1970 | Tirone | 362/396 |
| 4,234,915 | 11/1980 | Malinowski et al. | 362/252 |
| 4,428,032 | 1/1984 | Workman | 362/249 |
| 4,550,363 | 10/1985 | Sandell | 362/351 |
| 4,833,580 | 5/1989 | Allen | 362/451 |
| 5,021,935 | 6/1991 | Gary | 362/237 |
| 5,361,192 | 11/1994 | Lai | 362/123 |

*Primary Examiner*—Alan Cariaso

[57] ABSTRACT

A bell-shaped Christmas tree light cover system is provided including a plurality of cylindrical bulb sockets electrically connected to and spacedly coupled along a wire which is coupleable to a power source. Each socket has an aperture formed in an end thereof opposite the wire for releasably receiving a small bulb therein and illuminating the same. A plurality of bell shaped housings are provided each constructed from a transparent material and having a circular aperture formed in an apex thereof for removably receiving one of the bulb sockets. Finally, mounting mechanisms for precluding the removal of the sockets from the respective housings are included.

2 Claims, 2 Drawing Sheets

BELL-SHAPED CHRISTMAS TREE LIGHT COVER

BACKGROUND OF THE INVENTION

1. Field of the Invention

The present invention relates to a bell-shaped Christmas tree light cover and more particularly pertains to improving the aesthetic appearance of Christmas lights.

2. Description of the Prior Art

The use of Christmas tree light shades is known in the prior art. More specifically, Christmas tree light shades heretofore devised and utilized for the purpose of illuminating the same are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,361,192; U.S. Pat. No. 4,833,580; U.S. Pat. Des. No. 272,523; U.S. Pat. No. 5,021,935; U.S. Pat. No. 4,234,915; and U.S. Pat. No. 4,550,363.

In this respect, the bell-shaped Christmas tree light cover according to the present invention substantially departs from the conventional concepts and designs of the prior art, and in so doing provides an apparatus primarily developed for the purpose of improving the aesthetic appearance of Christmas lights.

Therefore, it can be appreciated that there exists a continuing need for a new and improved bell-shaped Christmas tree light cover which can be used for improving the aesthetic appearance of Christmas lights. In this regard, the present invention substantially fulfills this need.

SUMMARY OF THE INVENTION

In view of the foregoing disadvantages inherent in the known types of Christmas tree light shades now present in the prior art, the present invention provides an improved bell-shaped Christmas tree light cover. As such, the general purpose of the present invention, which will be described subsequently in greater detail, is to provide a new and improved bell-shaped Christmas tree light cover which has all the advantages of the prior art and none of the disadvantages.

To attain this, the present invention essentially comprises a plurality of cylindrical bulb sockets electrically connected to and spacedly coupled along a double stranded wire. Such wire is coupleable to a power source via plug or the like. Each socket has an aperture formed in an end thereof opposite the wire for releasably receiving a small bulb therein and illuminating the same. As shown in the Figures, a plurality of bell shaped housings are provided. Each housing is constructed from a transparent material. In the alternative, the material may be translucent and tinted with one of various colors. To define a bell, each housing includes a hemispherical upper extent and a generally frusto conical lower extent. A lower edge of the lower extent has an arcuate cross-section and an open bottom. A circular aperture is formed in an apex of the upper extent of the housing for removably receiving one of the bulb sockets. Note FIG. 4. A pair of mounting bores are formed on opposite sides of the circular aperture. Associated therewith is a plurality of metal retainer clips each with a generally planar configuration. As best shown in FIG. 2, each clip has a central extent of a first width and outer extents of a second width less than the first width. Each metal retainer clip further has at each of the ends thereof a perpendicular extension integrally coupled thereto. See FIG. 4. By this structure, the extensions of each of the metal retainer clips are adapted to be coupled within the bores of an associated one of the bell shaped housings. As such, the clip has a bent, arcuate orientation and the central extent thereof abuts the socket of the corresponding housing thereby precluding the removal thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bell-shaped Christmas tree light cover which has all the advantages of the prior art Christmas tree light shades and none of the disadvantages.

It is another object of the present invention to provide a new and improved bell-shaped Christmas tree light cover which may be easily and efficiently manufactured and marketed.

It is a further object of the present invention to provide a new and improved bell-shaped Christmas tree light cover which is of a durable and reliable construction.

An even further object of the present invention is to provide a new and improved bell-shaped Christmas tree light cover which is susceptible of a low cost of manufacture with regard to both materials and labor, and which accordingly is then susceptible of low prices of sale to the consuming public, thereby making such bell-shaped Christmas tree light cover economically available to the buying public.

Still yet another object of the present invention is to provide a new and improved bell-shaped Christmas tree light cover which provides in the apparatuses and methods of the prior art some of the advantages thereof, while simultaneously overcoming some of the disadvantages normally associated therewith.

Still another object of the present invention is to improve the aesthetic appearance of Christmas lights.

Lastly, it is an object of the present invention to provide a new and improved bell-shaped Christmas tree light cover system including a plurality of cylindrical bulb sockets electrically connected to and spacedly coupled along a wire which is coupleable to a power source. Each socket has an aperture formed in an end thereof opposite the wire for releasably receiving a small bulb therein and illuminating the same. A plurality of bell shaped housings are provided each constructed from a transparent material and having a circular aperture formed in an apex thereof for removably receiving one of the bulb sockets. Finally, mounting mechanisms for precluding the removal of the sockets from the respective housings are included.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
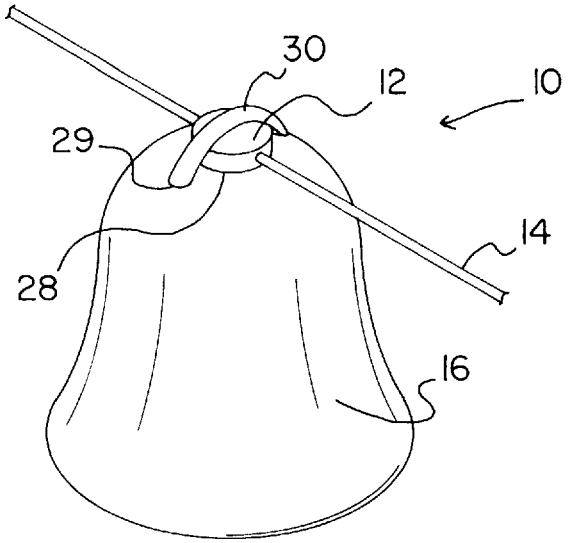
FIG. 1 is a perspective illustration of the preferred embodiment of the bell-shaped Christmas tree light cover constructed in accordance with the principles of the present invention.

With reference now to the drawings, and in particular to FIG. 1 thereof, a new and improved bell-shaped Christmas tree light cover embodying the principles and concepts of the present invention and generally designated by the reference numeral 10 will be described.

The present invention, the new and improved bell-shaped Christmas tree light cover, is comprised of a plurality of components. Such components in their broadest context include a plurality of bulb sockets with bulbs connected thereto, a plurality of bell-shaped housings, and a plurality of metal clips. Such components are individually configured and correlated with respect to each other so as to attain the desired objective.

More specifically, it will be noted that the system 10 of the present invention includes a plurality of cylindrical bulb sockets 12 electrically connected to and spacedly coupled along a double stranded wire 14. Such wire is coupleable to a power source via plug or the like. Each socket has an unillustrated aperture formed in an end thereof opposite the wire for releasably receiving a small bulb therein and illuminating the same.

As shown in the Figures, a plurality of hollow bell shaped housings 16 are provided. In the preferred embodiment, each housing has a height of about 3 and ⅝ inches and diameter of about 4 and ½ inches. Each housing is constructed from a transparent material. In the alternative, the material may be translucent and tinted with one of various colors. Preferably, the entire housing has a constant cross-sectional thickness. To define a bell, each housing includes a hemispherical upper extent 18 and a generally frusto conical lower extent 20. A lower edge of the lower extent has an arcuate cross-section 22 and an open bottom 24. As shown in the Figures, the transition between the upper and lower extent constitutes and inwardly tapering smooth generally cylindrical surface 26.

Figure 4:
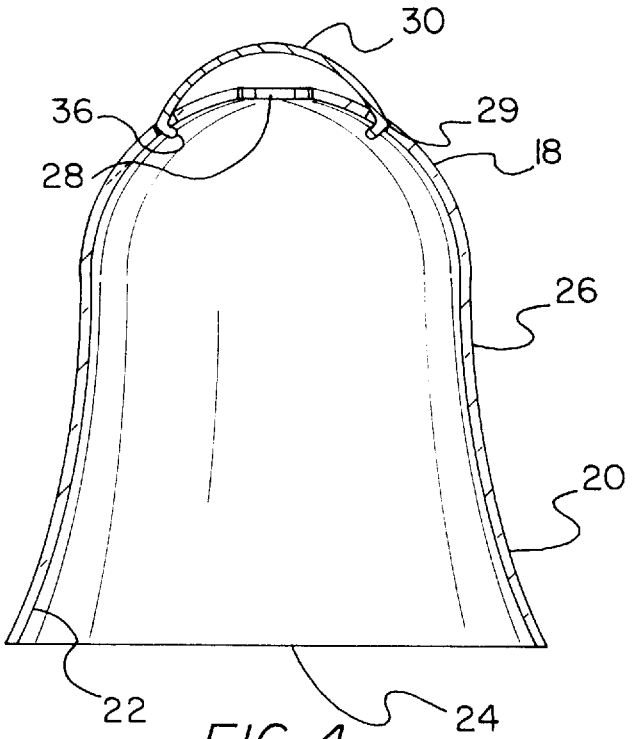
FIG. 4 is a cross-sectional view of the present invention.

A circular aperture 28 is formed in an apex of the upper extent of the housing for removably receiving one of the bulb sockets. Note FIG. 4. A pair of mounting bores 29 are formed on opposite sides of the circular aperture.

Figure 2:
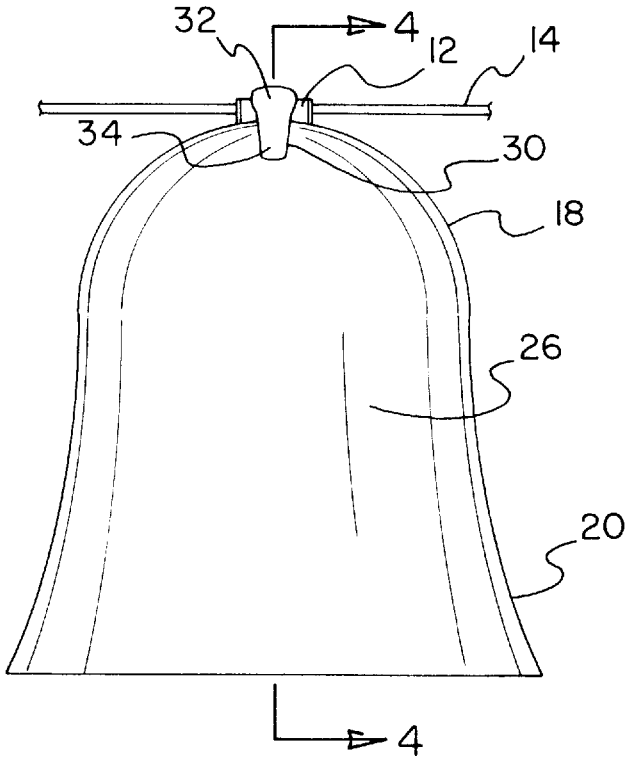
FIG. 2 is a side view of the preset invention.
Figure 3:
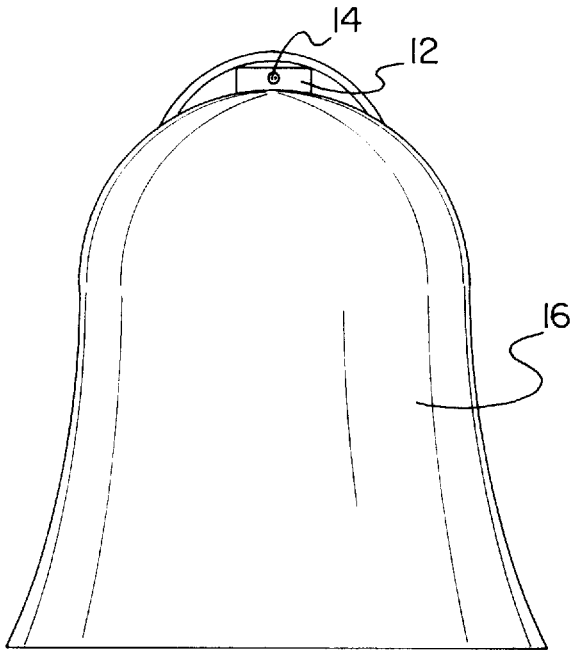
FIG. 3 is another side view of the present invention.

Associated therewith is a plurality of flexible metal retainer clips 30 each with a generally planar configuration. As best shown in FIG. 2, each clip has a central extent 32 of a first width and outer extents 34 of a second width less than the first width. Each metal retainer clip further has at each of the ends thereof a perpendicular extension 36 integrally coupled thereto. See FIG. 4.

By this structure, the extensions of each of the metal retainer clips are adapted to be coupled within the bores of an associated one of the bell shaped housings. To accomplish this, the extensions are preferably equipped with a bent portion which precludes the removal thereof from the associated bore. As such, the clip has a bent, arcuate orientation in its operative mode and the central extent thereof abuts the socket of the corresponding housing thereby precluding the removal thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bell-shaped Christmas tree light cover comprising, in combination:

a plurality of cylindrical bulb sockets electrically connected to and spacedly coupled along a double stranded wire which is coupled to a power source, each socket having an aperture formed in an end thereof opposite the wire for releasably receiving a small bulb therein and illuminating the bulb;

a plurality of bell shaped housings, each housing constructed from a transparent material and including a hemispherical upper extent and a generally frusto conical lower extent with a lower edge having an arcuate cross-section and an open bottom, a circular aperture formed in an apex of the upper extent of the housing for removably receiving one of the bulb sockets, and a pair of mounting bores formed on the housing and opposite sides of the bulb socket; and a plurality of metal retainer clips each with a generally planar configuration having a central extent of a first width and outer extents of a second width less than the first width, each metal retainer clip further having at each end thereof a perpendicular extension;

said extensions of each of the metal retainer clips coupled within the bores of an associated one of the bell shaped housings so that the clip has a bent, arcuate orientation and the central extent of the clip abuts the socket of the corresponding housing thereby precluding the removal of the socket from the housing.

2. A bell-shaped Christmas tree light cover comprising:

a plurality of cylindrical bulb sockets electrically connected to and spacedly coupled along a wire which is coupled to a power source, each socket having an aperture formed in an end thereof opposite the wire for releasably receiving a small bulb therein and illuminating the bulb;

a plurality of bell shaped housings each constructed from a transparent material and having a circular aperture formed in an apex of an upper extent thereof for removably receiving one of the bulb sockets; and mounting means for precluding the removal of the sockets wherein the mounting means includes a pair of mounting bores formed in each of the housings on opposite sides of the bulb socket and a plurality of metal retainer clips each having at each end thereof a perpendicular extension integrally coupled thereto so that said extensions of each of the metal retainer clips are coupled within the bores of an associated one of the bell shaped housings whereby the clip has a bent, arcuate orientation and a central extent of the clip abuts the socket of the corresponding housing thereby precluding the removal of the socket from the housing.

* * * * *